United States Patent [19]

Thompson

[11] 3,962,509

[45] June 8, 1976

[54] WATERPROOF PAPERBOARD AND METHOD FOR PRODUCING SAME

[75] Inventor: Charles E. Thompson, Ponca City, Okla.

[73] Assignee: Continental Oil Company, Ponca City, Okla.

[22] Filed: Dec. 24, 1974

[21] Appl. No.: 534,241

Related U.S. Application Data

[63] Continuation-in-part of Ser. No. 475,016, May 31, 1974, abandoned, which is a continuation-in-part of Ser. No. 448,092, March 4, 1974, abandoned.

[52] U.S. Cl. ..... 428/182; 427/372; 427/392; 427/442; 428/184; 428/486

[51] Int. Cl.[2] ..... B32B 3/28; B32B 3/00

[58] Field of Search ..... 428/182, 184, 186, 485, 428/486; 106/229; 156/210; 427/391, 442, 372, 235, 221

[56] References Cited

UNITED STATES PATENTS

| | | | |
|---|---|---|---|
| 2,204,612 | 6/1940 | Musher | 428/486 |
| 3,137,588 | 6/1964 | Taylor | 427/372 |
| 3,382,098 | 5/1968 | Fauber et al. | 428/182 |
| 3,653,958 | 4/1972 | Kohn et al. | 427/442 |
| 3,692,564 | 9/1972 | Gonta et al. | 427/235 |

*Primary Examiner*—Marion E. McCamish
*Assistant Examiner*—P. Thibodeau
*Attorney, Agent, or Firm*—F. Lindsey Scott

[57] ABSTRACT

Waterproof corrugated paperboard and other paper constructions and a process for producing such waterproof paperboard by impregnating paperboard with a mixture containing from about 10 to about 50 weight percent tung oil and from about 90 to about 50 weight percent paraffin wax and curing the impregnated paper at a temperature from about 80°C to about 163°C.

17 Claims, No Drawings

WATERPROOF PAPERBOARD AND METHOD FOR PRODUCING SAME

This application is a continuation-in-part of U.S. Ser. No. 475,016, filed May 31, 1974, now abandoned, entitled "Improved Method for Waterproofing Paper Constructions" which is a continuation-in-part of U.S. Ser. No. 448,092 filed Mar. 4, 1974, now abandoned, entitled "Impregnating Wax Composition."

The present invention relates to waterproof paperboard.

The present invention further relates to waterproof paperboard having a high wet compression strength.

The present invention further relates to a method for producing waterproof paperboard.

The present invention further relates to a method for producing waterproof paperboard by impregnating paperboard with a mixture of tung oil and paraffin and thereafter curing the impregnated paperboard at an elevated temperature.

For many packaging uses, it is essential to exclude water from the fibers of paper-derived materials to maintain the inherent dry strength of these materials. The corrugated paperboard industry has for years used large quantities of paraffin wax to impregnate the fibers of paperboard to aid in maintaining the wet strength. However, it was found that unmodified waxes give only partial protection from water. This disadvantage was overcome to some extent by the addition of polyethylene and other polymers and copolymers. However, the expense, the high temperatures necessary for blending such mixtures, and the relative incompatability of some of these polymer additives were disadvantages of these compositions in corrugated paperboard applications.

Corrugated paperboard has also been made with a bituminous layer interposed between intermediate piles of the sheet to render the board resistant to water vapor transmission. However, this type of corrugated paperboard was found lacking in wet strength properties necessary for stacking, especially when in direct contact with water or exposed to moisture-laden atmospheres for long periods of time. This loss of wet strength was attributed to moisture absorbance of the outer unprotected surfaces of the paperboard.

The corrugated paperboard industry has often used curtain coatings as exterior protection against moisture absorbance; however, this technique has not been entirely successful since it is quite difficult to prevent moisture from wicking into corrugated board through the many exposed fibers protruding from the surface thereof.

U.S. Pat. No. 2,204,612, issued to Musher, discloses that packaging materials which carry waterproofing, such as paraffin wax, and contain virgin glyceride oils are protected against oxidative change. Musher discloses tung oil as an example of a lesser preferred glyceride. The virgin glycerides disclosed by Musher are prepared by special processes as set forth at column 1, page 2, to preserve antioxidant activity. Musher does not show a curing step.

U.S. Pat. No. 1,307,373 issued June 24, 1919, to Pearson discloses the use of selenium tungate to overcome disadvantages of paraffinic mixtures containing vegetable drying oils alone.

U.S. Pat. No. 2,290,707 issued July 21, 1942, to Plumb discloses the use of tung oil-paraffin mixtures as a painting material for porous surfaces. The mixture is heated to provide a desired viscosity, but there is no indication that a curing step would be beneficial.

U.S. Pat. No. 2,199,193 issued Aug. 30, 1940, to Baldeschwieler et al discloses that mixtures of cracking coil tar with paraffin offer advantages over tung oil-paraffin mixtures as weatherproofing coatings for building materials.

U.S. Pat. No. 827,123 issued July 31, 1908 to Smillie discloses various mixtures of paraffins and bland, non-drying oleaginous agents such as linseed oil for treating paper. The treated paper is dried naturally or artificially. There is no indication that a curing step was considered desirable.

U.S. Pat. No. 3,692,564 issued Sept. 19, 1972, to Gonta et al discloses that wax temperature control is beneficial in achieving maximum surface coating with minimum wax penetration into the interior of the paperboard.

An ideal corrugated paperboard would be one which completely excludes moisture and has wet strength properties equivalent to its dry strength properties. Recently, phenolic resins and urea-formaldehyde resins have been used commercially in attempts to impart water resistance to corrugated board; however, these resins have provided more rigidity to the board than water resistance. Further, wax and resin mixtures have been employed in attempts to achieve water resistance in board, but these too have not been entirely successful.

As a result of the continued need for a waterproof paperboard having a high wet compression strength a continuing effort has been directed to the development of such a waterproof paperboard.

Therefore, it is an object in the present invention to provide a method for waterproofing paper constructions such as corrugated paperboard.

It is a further object of the present invention to achieve a waterproof paperboard of improved wet strength properties.

A further object of the present invention is to provide an effective, simple and economic method whereby waterproof paperboard having wet strength properties equivalent to its dry strength properties is produced.

It has now been found that a waterproof paperboard having a water pickup of less than 20 percent and a high wet strength is produced by a process consisting essentially of impregnating paperboard with a mixture consisting essentially of from about 10 to about 50 weight percent tung oil and from about 90 to about 50 weight percent paraffin wax and thereafter curing the impregnated paperboard at a temperature from about 80° to about 163°C.

In the practice of the present invention a mixture consisting of essentially from about 10 to about 50 weight percent tung oil and from about 90 to about 50 weight percent paraffin wax is used to impregnate the paperboard. The mixtures are formed by methods known to those skilled in the art such as by mixing solid tung oil and solid paraffin and thereafter melting, mixing melted tung oil and melted wax, and the like. Such methods are known to those skilled in the art and need not be discussed further.

The paperboard is impregnated with the mixture by dipping the paperboard into the molten mixture and the like as is known to those skilled in the art. The ingredients in the mixture result in a desirable paperboard when the tung oil is present in an amount of from about 10 to about 50 weight percent and the paraffins are present in an amount from about 90 to about 50 weight percent. Preferably, the tung oil is present in an amount equal to from about 15 to about 35 weight percent with the paraffin being present in an amount equal to from about 65 to about 85 weight percent. Particularly desirable results have been achieved wherein from about 20 to about 30 weight percent tung oil is present in a mixture containing from about 80 to about 70 weight percent paraffin wax.

As is well known to those skilled in the art, it may be desirable in some instances when heavier paraffins are used and the like to use a solvent such as trichloroethylene and the like. Desirably, such solvent is present in no more than the amount required to obtain a mixture of a desired consistency for the particular coating requirements of the user and the like. Trichloroethylene and like solvents are lost upon drying and accordingly do not comprise a substantial portion of the mixture after curing. Desirably the solvent is present in no more than about 25 weight percent based on the weight of the mixture containing the solvent.

In the practice of the present invention the curing is at a temperature from about 80° to about 163°C. A preferred range is from about 90° to about 140°C and particularly desirable results have been achieved with temperatures from about 105° to about 125°C. It is clear that the curing temperature will vary dependent upon the given type of paper construction, percentage of impregnation, type of wax employed, the presence of catalysts and the like. Such variables are well known to those skilled in the art and need not be discussed further. Desirable results have been obtained at curing times from about 5 minutes to about 6 hours using conventional ovens. Further desirable curing has been achieved in as little as 1 minute using microwave ovens and the like. Clearly the curing time is sufficient when the mixture has been cured to provide the desired waterproof coating.

The amount of mixture impregnated into the paperboard will vary substantially depending upon the particular paperboard used and the like. Typically, from about 10 to about 60 weight percent based on the original dry board weight of the mixture is used to impregnate the paperboard. Although more desirable results have been obtained when from about 20 to about 55 weight percent of the mixture was used to impregnate the paperboard.

As more clearly shown in the following examples, the use of particular proportions of tung oil and paraffin in the mixture is essential to the successful operation of the present invention to produce a waterproof paperboard having the desired properties. Waterproof is not used in an absolute sense. Paperboard having a water pickup value as high as 20 percent is desirable. In many instances the paperborad produced by the present process has a water pickup of less than 10 percent which represents little more water than is physically retained in an unabsorbed state in the fluted corrugated paper constructions commonly used in industry after draining. Numerous unsaturated oils were evaluated and surprisingly tung oil in mixture with paraffin wax in the proportions shown was found to be surprisingly superior to the other oils evaluated.

It is also critical that the impregnated paperboard be cured at an elevated temperature. While Applicant does not wish to be bound by any particular theory, it is believed that the curing step is necessary to cause the tung oil to polymerize, cross-link or otherwise chemically react to produce the desired coating material in and on the surfaces of the paperboard. It is also believed possible that the tung oil may react in some instances with the hydroxyl groups associated with the cellulosic components and the like of the paperboard material itself since a much superior waterproofing is achieved after the curing treatment than is achieved by merely coating the paper with the mixture or by coating the paper with a mixture containing oils other than tung oil. As noted above, while Applicant does not wish to be bound by any particular theory, it is considered critical to the practice of the present invention that the impregnated paperboard be cured at an elevated temperature for an effective period of time.

Paperboard materials suitable for use in the method of the present invention are paperboard materials generally and more particularly fluted corrugated paperboard materials such as are commonly used in the preparation of paperboard boxes and the like. In the use of such boxes for storing vegetables and other materials which contain or are likely to come in contact with moisture, it is highly desirable that the paperboard material be resistant to water pickup and that the compressive strength of the paperboard material be maintained in the presence of water.

The paperboards produced by the method of the present invention in addition to having a low water pickup also exhibit excellent wet compressive strength. Wet column compression strengths of at least 50 pounds/inch have been achieved with many tests showing wet compression strengths in excess of 100 pounds per inch.

Having thus described certain preferred embodiments of the invention it is pointed out that the embodiments described are by way of illustration rather than limitation and that many variations and modifications are possible within the scope of the present invention. It is anticipated that many such variations and modifications may be considered obvious or desirable to those skilled in the art upon a review of the foregoing description of preferred embodiments and the appended examples.

Examples

In the following tests laboratory test specimens (5 by 5 inches) of 275-lb corrugated board of Type C flute construction were stored overnight at TAPPI (Technical Association of the Pulp and Paper Industry — temperature 75° ± 2°F at a humidity of 50 percent) conditions and then weighed. The weighed specimens were dipped into a raw tung oil-paraffin wax mixture at 200°F (90°C) for 10 seconds and then inverted several minutes for draining on a warm tray lined with paper towels. The impregnated samples were then allowed to recondition overnight at TAPPI conditions and subsequently placed in a circulating air oven for curing.

The cured samples were then returned to TAPPI conditions overnight and then reweighed in order to determine the amount of impregnate pickup as a percentage of the original board weight. The curred samples were subsequently evaluated for water pickup, wet column compression strength and dry column compression strength. The water pickup test consisted of weighing the specimen, immersing it in water for 1 hour, removing excess water by shaking and blotting and subsequently reweighing to determine the amount of water absorbed which is recorded as a percentage of the impregnated board weight. The column compression tests were a modification of TAPPI T-811 (TAPPI standards — testing methods, recommended practices, specifications of the Technical Association of the Pulp and Paper Industry — Method T-811-Edgewise Compression strength of corrugated fiberboard) using an Instron tester manufactured by the Instron Corporation, 2500 Washington Street, Canton, Massachusetts, to crush the samples which were held in a TMI holder manufactured by Testing Machines Incorporated, 72 Jerico Turnpike, Mineola, Long Island, New York. The samples were immersed in water for 1 hour prior to the wet column compression tests.

The wax employed in the raw tung oil-paraffin wax mixture used in the tests shown in the following tables was a fully refined paraffin wax having an ASTM melting point of 122°–126°F (50°–53°C) and a maximum oil content of 0.25 percent.

TABLE I

EFFECT OF CURING TEMPERATURE

Time in Oven, 4 Hours
Impregnant Composition, 25% Tung Oil — 75% Wax

| Oven Temperature °F | (°C) | Impregnant Pickup % | Water Pickup % | Wet Column Compression lbs/in | Dry Column Compression lbs/in |
|---|---|---|---|---|---|
| 73 | (23) | 47–48 | 24 | 11 | 106 |
| 175 | (80) | 44–46 | 10 | 70 | 117 |
| 250 | (121) | 41 | 4 | 109 | 126 |
| 325 | (163) | 25 | — | 85 | — |

Table I demonstrates that as curing temperature increases the percent water pickup decreases and the strength of the board increases significantly. The amount of impregnant retained by the board decreases with increased temperature. At 325°F (163°C) the amount of impregnant mixture retained by the board was almost one-half the amount retained at 175°F (80°C) and 250°F (121°C), thus resulting in a slightly lowered wet column compression strength. Water pickup and dry column compression tests were not performed on the 325°F (163°C) sample.

TABLE II

EFFECT OF TIME IN OVEN

Oven Temperature, 250°F (121°C)
Impregnant Composition, 25% Tung Oil — 75% Wax

| Oven Time Hrs. | Impregnant Pickup % | Water Pickup % | Wet Column Compression lbs/in | Dry Column Compression lbs/in |
|---|---|---|---|---|
| 0 | 47–48 | 24 | 11 | 106 |
| 1 | 43 | — | 68 | — |
| 2 | 41 | 4 | 100 | 122 |
| 4 | 40–41 | 4 | 109 | 126 |
| 6 | 39 | — | 115 | — |

Table II demonstrates that as curing time increases, the percent water pickup decreases, the strength of the board increases, and the amount of impregnant retained decreases.

The following Table III demonstrates the improved properties achieved through curing even when there is only a small amount of tung oil in the impregnating mixture. The table illustrates that the optimum amount of tung oil is about 25 percent with strength property values being less at percentages both above and below 25 percent.

TABLE III

EFFECT OF AMOUNT OF TUNG OIL IN THE MIXTURE

Oven Temperature, 250°F (121°C)
Time in Oven, 2 Hours

| Tung Oil Mixture % | Impregnant Pickup % | Water Pickup % | Wet Column Compression lbs/in | Dry Column Compression lbs/in |
|---|---|---|---|---|
| 0* | 44 | 27 | 38 | 112 |
| 10 | 45 | 16 | 52 | 115 |
| 15 | 42 | 8 | 75 | 116 |
| 25 | 41 | 4 | 100 | 122 |
| 35 | 42 | 6 | 84 | — |
| 50 | 46 | 8 | 71 | 118 |
| 100 | 61 | 11 | 53 | 118 |

*Not Oven Cured

The time required for curing to achieve improved strength properties of a given paper construction can be accelerated, if one desires, by utilizing a polymerization catalyst. The laboratory test specimens used to obtain the data presented in Tables IV through VIII were the same type board as used to obtain the data presented in Tables I through III except that the specimens of Tables IV through VIII were pretreated with cobalt and zircon-containing catalysts known as Advadry driers and supplied by Cincinnati Milacron Chemical Company. The treatment level was about 0.015 grams of each metal per square foot of paperboard. Catalyst content as low as 0.00375 grams of each metal per square foot of board was also investigated and found to be effective (as shown in Table IV).

TABLE IV

EFFECT OF CATALYST TREATMENT

Oven Temperature, 250°F (121°C)
Time in Oven, 2 Hours
Impregnant Composition, 25% Tung Oil — 75% Wax

| Total Catalyst Level gms/ft² | Impregnant Pickup % | Wet Column Compression lbs/in |
|---|---|---|
| 0.030 | 37 | 114 |
| 0.0075 | 39 | 109* |
| Nil | 35 | 68 |

The data in Table IV demonstrates the effect of catalyst treatment on board cured for 2 hours at a temperature of 250°F (121°C). Even at the very low level of 0.0075 grams of each metal per square foot of board, the wet column compression was about the same as the 0.030 gms/ft² level and much better than no catalyst at all.

The data in Tables V and VI, when compared with the data of Tables I through II, demonstrate that through the employment of a catalyst improved wet strength properties are achieved within a shorter curing time than when cured in the absence of a catalyst. For instance, in Table I, a specimen which was cured for 4 hours at a temperature of 250°F (121°C) without catalyst treatment yielded a wet column compression value of 109 lbs/in; whereas, in Table V, a catalyst-treated specimen cured for 2 hours at a temperature of 250°F (121°C) gave a wet column compression of 139 lbs/in.

TABLE V

EFFECT OF CURING TEMPERATURE ON CATALYST-TREATED BOARD

Time in Oven, 2 Hours
Impregnant Composition, 25% Tung Oil — 75% Wax

| Oven Temperature °F | (°C) | Impregnant Pickup % | Wet Column Compression lbs/in |
|---|---|---|---|
| 200 | (90) | 52 | 97 |
| 225 | (107) | 51 | 121 |
| 250 | (121) | 48 | 139 |
| 275 | (135) | 41 | 114 |

TABLE VI

EFFECT OF TIME IN OVEN ON CATALYST-TREATED BOARD

Oven Temperature, 250°F (121°C)
Impregnant Composition, 25% Tung Oil — 75% Wax

| Oven Time Hours | Impregnant Pickup % | Wet Column Compression lbs/in |
|---|---|---|
| 0.5 | 50 | 113 |
| 1 | 50 | 110 |
| 2 | 48 | 139 |
| 4 | 45 | 130 |

The technique for impregnating specimens used to obtain the data in Tables I through VI resulted in the maximum pickup of impregnant that the board could accommodate. In commercial applications such techniques as roll coating and curtain coating provide the means for metering or controlling the amount of impregnant to preselected levels below saturation. To study the effect on strength properties of partial impregnation of tung oil-wax mixture, the impregnant mixture was blended with a solvent, trichloroethylene. The specimens were dipped in the impregnant solvent mixture of tung oil and wax, subsequently placed under vacuum to remove the solvent followed by overnight conditioning in a TAPPI room.

Table VII demonstrates the effect on wet column compression of catalyst-treated board at impregnation levels of 13 thru 48 percent. In comparing the illustrated impregnation levels, one can readily discern that the lower level of impregnation was not as effective in providing wet strength as the higher level of impregnation; however, comparison with the data in Table III illustrates that a low level of impregnation combined with adequate curing provides strength protection superior to a higher level of impregnation of wax alone. Further, in comparing the data in Table VII with that in Table III, note that a 25 percent tung oil in wax mixture at 23 percent impregnation is about equivalent in strength properties to a 10 percent tung oil in wax mixture at 45 percent impregnation.

TABLE VII

EFFECT OF PERCENT IMPREGNATION OF CATALYST-TREATED BOARD

Impregnant Composition, 25% Tung Oil — 75% Wax
Curing Time, 2 Hours
Oven Temperature, 250°F (121°C)

| Impregnant Pickup % | Wet Column Compression lbs/in |
|---|---|
| 13 | 22 |
| 23 | 60 |
| 26 | 69 |
| 37 | 114 |
| 48 | 139 |

In the commercial operation of the present invention, it is anticipated that heat curing would follow immediately after impregnation. Table VIII demonstrates the results obtained by placing the specimens in the curing oven immediately after dipping and removal of excess impregnant. The impregnant was not in solvent solution and the dipping procedure was the same as previously described.

TABLE VIII

EFFECT OF IMMEDIATE TRANSFERRAL TO CURING OVEN OF CATALYZED BOARD

Impregnant Composition, 25% Tung Oil — 75% Wax

| Oven Time Hrs. | Oven Temperature °F | (°C) | Wet Column Compression lbs/in |
|---|---|---|---|
| 1/12 | 200 | (90) | 85 |
| 1/4 | 200 | (90) | 100 |
| 1/2 | 200 | (90) | 96 |
| 1 | 200 | (90) | 101 |
| 2 | 200 | (90) | 106 |
| 1/12 | 250 | (121) | 73 |
| 1/4 | 250 | (121) | 77 |
| 1/2 | 250 | (121) | 96 |
| 1 | 250 | (121) | 104 |

By comparison of data in Tables V, VI, and VIII, one can find no significant difference in wet strength properties, thereby demonstrating that a time of conditioning after impregnation is not required prior to heat curing to achieve satisfactory results.

Example 2

The following tests using different unsaturated oils were conducted to determine the effectiveness of such oils. The oils were used at the percentages shown and the impregnated boards were prepared by the techniques described in Example 1. The tests were identical except for the variation of the weight percent unsaturated material using "RYCON 150" and the variation in the type of unsaturated oil used.

TABLE IX

| Oil in Mixture (wt %) | Type Oil in Mixture | Wet Column Compression (lb/in) Without Catalyst | With Catalyst | Wax Pick-up, % |
|---|---|---|---|---|
| 25 | Tung Oil | 68 | 109 | 39 |
| 25 | Linseed Oil (ADM non-break) | 19 | 41 | 37 |
| 25 | Metalyn 400 (Hercules tall-oil ester) | 12 | 11 | 34 |
| 25 | Cykelin (Spencer Kellogg dicyclopentadiene modi- | | | |

TABLE IX-continued

| Oil in Mixture (wt %) | Type Oil in Mixture | Wet Column Compression (lb/in) Without Catalyst | With Catalyst | Wax Pick-up, % |
|---|---|---|---|---|
| | fied linseed) | 22 | 64 | 38 |
| 25 | Polymerized Linseed (Spencer Kellogg polymerized linseed) | 18 | 48 | 39 |
| 25 | Wochem 430 (Distilled dehydrated castor oil fatty acid) | 12 | 13 | 34 |
| 25 | Wochem 400 (Tung oil fatty acid) | 19 | 22 | 36 |
| 20 | Ricon 150 (Polybutadiene homopolymer) | 20 | 29 | 33 |
| 25 | Oiticica Oil | — | 72 | 43 |

It is clear that surprisingly superior results were obtained with the tung oil, particularly when no catalyst was used. It will be noted that the wax pickup was approximately the same in all instances; however, the wet column compression strengths are markedly superior when tung oil is used. No completely satisfactory explanation for this surprising superiority of the tung oil blends is now known to the Applicant; however, it is apparent that a greatly superior impregnated board is produced using the tung oil mixture and curing procedures as described herein.

Example 3

In a further test an impregnated paperboard prepared in a manner similar to those described in Example 1 wherein the mixture contained 25 weight percent tung oil and a catalyst was cured in a microwave oven for 1 minute. The wet column compression strength was 105 lb/in. It is believed that possibly even shorter times might be sufficient in some instances when microwave ovens are used.

Having thus described the invention, I claim:

1. A waterproof paperboard having a water pickup of less than 20% and a high wet strength, said waterproof paperboard being produced by a process consisting essentially of:

a. impregnating paperboard with a mixture consisting essentially of from about 10 to about 50 weight percent tung oil and from about 90 to about 50 weight percent paraffin wax; and, b. heating said impregnated paperboard at a temperature from about 80° to about 163°C for a time to effect curing of said waterproof paperboard.

2. The waterproof paperboard of claim 1 wherein said paperboard is fluted corrugated paperboard.

3. The waterproof paperboard of claim 2 wherein said waterproof paperboard has a wet column compression strength of at least 50 lb/in.

4. The waterproof paperboard of claim 3 wherein said waterproof paperboard has a water pickup of less than 10 percent.

5. The waterproof paperboard of claim 4 wherein said mixture contains from about 15 to about 35 weight percent tung oil and from about 65 to about 85 weight percent paraffin.

6. The waterproof paperboard of claim 5 wherein said paperboard is impregnated with from about 10 to about 60 weight percent of said mixture based on the weight of said paperboard.

7. The waterproof paperboard of claim 6 wherein said temperature is from about 90° to about 120°C.

8. The waterproof paperboard of claim 7 wherein said waterproof paperboard has a wet column compression strength of at least 60 lb/in, said mixture contains from about 20 to about 30 weight percent tung oil and from about 80 to about 70 weight percent paraffin and said paperboard is impregnated with from about 20 to about 55 weight percent of said mixture.

9. A method for producing waterproof paperboard having a water pickup of less than 20 percent and a high wet strength, said method consisting essentially of:

a. impregnating paperboard with a mixture consisting essentially of from about 10 to about 50 weight tung oil and from about 90 to about 50 weight percent paraffin wax; and, b. heating said impregnated paperboard at a temperature from about 80° to about 163°C for a time to effect a cure of said paperboard to produce said waterproof paperboard.

10. The method of claim 9 wherein said waterproof paperboard is fluted corrugated paperboard.

11. The method of claim 10 wherein said waterproof paperboard has a wet column compression strength of at least 50 lb/in.

12. The method of claim 11 wherein said waterproof paperboard has a water pickup of less than 10 percent.

13. The method of claim 12 wherein said mixture contains from about 15 to about 35 weight percent tung oil and from about 65 to about 85 weight percent paraffin.

14. The method of claim 13 wherein said waterproof paperboard is impregnated with from about 10 to about 60 weight percent of said mixture based on the weight of said paperboard.

15. The method of claim 14 wherein said temperature is from about 90° to about 120°C.

16. The method of claim 15 wherein said waterproof paperboard has a wet column compression strength of at least 60 lb/in, said mixture contains from about 20 to about 30 weight percent tung oil and from about 80 to about 70 weight percent paraffin and said paperboard is impregnated with from about 20 to about 55 weight percent of said mixture.

17. The method of claim 9 wherein said paperboard is impregnated with a catalyst prior to impregnation with said mixture.

* * * * *